US011028336B2

(12) United States Patent
Malm et al.

(10) Patent No.: US 11,028,336 B2
(45) Date of Patent: Jun. 8, 2021

(54) OIL PURIFICATION PROCESS

(71) Applicant: NESTE OYJ, Espoo (FI)

(72) Inventors: Annika Malm, Espoo (FI); Mervi Waddilove, Espoo (FI)

(73) Assignee: NESTE OYJ, Espoo (FI)

( * ) Notice: Subject to any disclaimer, the term of this patent is extended or adjusted under 35 U.S.C. 154(b) by 0 days.

(21) Appl. No.: 16/337,726

(22) PCT Filed: Sep. 28, 2017

(86) PCT No.: PCT/EP2017/074578
§ 371 (c)(1),
(2) Date: Mar. 28, 2019

(87) PCT Pub. No.: WO2018/060302
PCT Pub. Date: Apr. 5, 2018

(65) Prior Publication Data

US 2020/0040278 A1 Feb. 6, 2020

(30) Foreign Application Priority Data

Sep. 30, 2016 (FI) ..... 20165734

(51) Int. Cl.
*C11B 3/00* (2006.01)
*C11B 3/04* (2006.01)
*C11B 3/16* (2006.01)

(52) U.S. Cl.
CPC ..... *C11B 3/001* (2013.01); *C11B 3/008* (2013.01); *C11B 3/04* (2013.01); *C11B 3/16* (2013.01)

(58) Field of Classification Search
CPC . C11B 3/001; C11B 3/008; C11B 3/04; C11B 3/16
USPC ..... 554/176
See application file for complete search history.

(56) References Cited

U.S. PATENT DOCUMENTS

| | | | |
|---|---|---|---|
| 2,182,755 | A | 12/1939 | Benjamin et al. |
| 2,601,375 | A | 6/1952 | Durkee |
| 2,657,224 | A | 10/1953 | Bierke |
| 2,728,714 | A | 12/1955 | Winkler et al. |
| 3,758,533 | A | 9/1973 | Lee |
| 3,984,447 | A | 10/1976 | Cooper et al. |
| 4,033,859 | A | 7/1977 | Davidson et al. |
| 4,865,978 | A | 9/1989 | Serota |
| 5,306,419 | A | 4/1994 | Harrison et al. |
| 5,676,840 | A | 10/1997 | Paul |

(Continued)

FOREIGN PATENT DOCUMENTS

| | | | |
|---|---|---|---|
| CN | 103224836 | A | 7/2013 |
| CN | 104479863 | A | 4/2015 |

(Continued)

OTHER PUBLICATIONS

Rade D et al: "Effect of Soybean Pretreatment on the Phospholopid Content in Crudeand Degummed Oils", FETT Lipid.Fat Science Technology, vol. 97,1995, pp. 501-507.*

(Continued)

*Primary Examiner* — Deborah D Carr
(74) *Attorney, Agent, or Firm* — Buchanan Ingersoll & Rooney PC

(57) ABSTRACT

The invention relates to a process for purification of oil by heat treatment in order to degrade phospholipids present in the non-purified oil.

12 Claims, 9 Drawing Sheets

(56) References Cited

U.S. PATENT DOCUMENTS

| | | | |
|---|---|---|---|
| 7,262,311 | B2 | 8/2007 | Christianson et al. |
| 2009/0266743 | A1 | 10/2009 | Yao et al. |
| 2011/0047866 | A1 | 3/2011 | Bao et al. |
| 2011/0077436 | A1 | 3/2011 | Yao et al. |
| 2011/0184201 | A1 | 7/2011 | Mcneff |
| 2013/0345457 | A1 | 12/2013 | Mcneff |
| 2014/0087042 | A1 | 3/2014 | Gordon et al. |
| 2016/0060565 | A1 | 3/2016 | Perez et al. |

FOREIGN PATENT DOCUMENTS

| | | | | | |
|---|---|---|---|---|---|
| DE | 102011055559 | A1 | | 5/2013 | |
| EP | 0195991 | A2 | | 10/1986 | |
| FI | 96964 | C | | 9/1996 | |
| GB | 1065051 | A | | 4/1967 | |
| GB | 1470022 | A | | 4/1977 | |
| GB | 1510056 | A | * | 5/1978 | ..... C11B 3/001 |
| GB | 1510056 | A | | 5/1978 | |
| GB | 2412664 | A | | 10/2005 | |
| NL | 7205618 | A | | 10/1973 | |
| WO | 2010010364 | A2 | | 1/2010 | |
| WO | 2013006578 | A1 | | 1/2013 | |
| WO | 2014058294 | A1 | | 4/2014 | |
| WO | 2014081279 | A1 | | 5/2014 | |
| WO | WO-2014081279 | A1 | * | 5/2014 | ..... C11B 3/10 |

OTHER PUBLICATIONS

Finnish Search Report for Finnish Patent Application No. 20165735 dated Jan. 30, 2017. (2 pages).

International Preliminary Report on Patentability (PCT/IPEA/409) dated Sep. 19, 2018, by the European Patent Office as the International Searching Authority for International Application No. PCT/EP2017/074611. (11 pages).

International Search Report (PCT/ISA/210) dated Jan. 2, 2018, by the European Patent Office as the International Searching Authority for International Application No. PCT/EP2017/074611. (3 pages).

Written Opinion (PCT/ISA/237) dated Jan. 2, 2018, by the European Patent Office as the International Searching Authority for International Application No. PCT/EP2017/074611. (8 pages).

International Preliminary Report on Patentability (PCT/IPEA/409) dated Jan. 30, 2019 by the European Patent Office as the International Searching Authority for International Application No. PCT/EP2017/074583. (15 pages).

International Search Report (PCT/ISA/210) dated Feb. 5, 2018, by the European Patent Office as the International Searching Authority for International Application No. PCT/EP2017/074583. (3 pages).

Written Opinion (PCT/ISA/237) dated Feb. 5, 2018, by the European Patent Office as the International Searching Authority for International Application No. PCT/EP2017/074583. (7 pages).

Written Opinion of the International Preliminary Examining Authority (PCT/IPEA/408) dated Aug. 20, 2018, by the European Patent Office as the International Searching Authority for International Application No. PCT/EP2017/074583. (4 pages).

U.S. Appl. No. 16/337,744, "Method for Purification of Animal or Vegetable Fats" by Pia Bergström, et al., filed Mar. 28, 2019.

U.S. Appl. No. 16/337,717, "Water Treatment of Lipid Material" by Blanka Toukoniitty, et al., filed Mar. 28, 2019.

International Preliminary Report on Patentability issued in corresponding International Patent Application No. PCT/EP2017/074578, 6 pages (dated Jan. 3, 2019).

International Search Report and Written Opinion issued in corresponding International Patent Application No. PCT/EP2017/074578, 9 pages (dated Dec. 1, 2017).

Rade D. et al., "Effect of Soybean Pretreatment on the Phospholipid Content in Crude and Degummed Oils," FETT—Lipid.Fat Science Technology, Wiley-VCH Verlag, Weinheim, DE, vol. 97, Jan. 1, 1995, pp. 501-507.

Search Report issued in corresponding Finnish Patent Application No. 20165734, 2 pages (dated Jan. 30, 2017).

* cited by examiner

OIL PURIFICATION PROCESS

FIELD OF INVENTION

Present invention relates to a process for purification of oil by heat treatment in order to remove phosphorous and metal compounds present in the non-purified oil and a subsequent process comprising e.g. water or acid treatment, degumming, bleaching or a combination thereof, thereby removing impurities from oil before feeding the purified oil into a catalytic process.

BACKGROUND OF THE INVENTION

It is a well-known fact that oils and fats can contain phospholipids and other impurities that have to be removed from the feed before catalytic processing as they cause plugging and inactivation of the catalyst. Generally refining processes used before catalytic production of fuels or chemicals are adopted from edible oil refining, such as chemical and physical refining. However, these techniques may not be fully suitable for the most difficult oils such as animal fat, damaged rapeseed oil, used cooking oil or algal oil.

It is also a well-known fact that phospholipids are prone to thermal degradation. Especially prone to degradation are the amino group containing phosphatidylethanolamines (PE). On the other hand, phosphatidylcholines (PC) has been reported as most resistant to thermal treatment. Phosphatidylinositols (PI), phosphatidic acids (PA) and phosphatidylethanolamines (PE) has been shown to degraded almost completely in 1 hour at 174° C.

Within the field, thermal cracking of these impurities at deoxygenation temperatures has been suggested in US Patent Application US 2009/0266743 wherein temperatures up to 540° C. is used.

GB 1470022 relates to purification of used lubricating oils, e.g. from motor car engines, gear-boxes and differentials, containing metal compounds by heating to 200-500° C., cooling and then filtering through a semi-permeable membrane having a cut zone in the range 5000-300,000 and which is permeable to the oil but not substantially permeable to the impurities to be removed. The heating can be carried out in the presence of water, steam and/or slaked lime.

SUMMARY OF THE INVENTION

Present invention relates to thermal treatment conducted at a temperature of about 220-260° C. or about 220-300° C. The severity of the thermal treatment determines the degree of degradation of phosphorous and/or metal compounds, and which phosphorous and/or metal compounds remain in the oil. The target for the heat treatment is to degrade at least those phosphorous compounds that are difficult to remove by water wash (e.g. nonhydratable phospholipids). All impurities may be removed in subsequent process steps. Such process step may comprise water washing, water or acid treatment, degumming or bleaching or any other suitable post treatment.

Consequently, present invention relates to a method for purification of lipid material, the method comprising a) providing a feed of lipid material, b) heat treating the lipid material without adding water or other solvent, c) post treating the heat treated lipid material to thereby remove phosphorous and/or metal compounds from the lipid material.

The lipid material to be purified according to the invention may be e.g. plant based, microbial based or animal based lipids or any combination thereof.

Primarily, the method according to the invention is aimed at removing phosphorous and metal compounds, such that the purified material is suitable for further use in subsequent processes such as e.g. catalytic processes where it is paramount that the level of impurities is low enough in order to avoid e.g. poisoning of the catalyst. Further impurities that are removed are e.g. metals.

It should be noted that step c) relating to post treatment of the heat treated lipid material may comprise one or more subsequent steps that may comprise one or more different post treatment techniques in any order. For example, step b) may be followed by a water treatment step which may be combined with further subsequent post treatment steps.

Thus present invention provides a method avoiding addition of water or any other solvent during the heat treatment step of the lipid material.

Present invention also relates to use of an unpurified lipid material in a method according to the invention for preparation of fuels or chemicals.

DETAILED DESCRIPTION OF THE INVENTION

As mentioned above present invention relates to a method for purifying a lipid feed. The lipid feed/oil is heated at such temperatures that essentially all phosphorous and/or metal compounds are degraded. The degraded phosphorous and/or metal compounds are removed from the oil in post-treatment, such as e.g. a water treatment followed by solids removal. Pre-treatment before heat treatment is possible but not mandatory. The resulting purified oil is essentially free from phosphorus and metal impurities.

Feedstock, i.e. the feed of lipid material, to be purified may contain impurities containing metals and phosphorus in the form of phospholipids, soaps or salts. Metal impurities that may be present in the feedstock may be e.g. alkali metals or alkali earth metals, such as sodium or potassium salts or magnesium or calcium salts or any compounds of said metals. The impurities may also be in form of phosphates or sulphates, iron salts or organic salts, soaps or e.g. phospholipids.

The phosphorous compounds present in the raw material may be phospholipids. The phospholipids present in the raw material may be one or more of phosphatidyl ethanolamines, phosphadityl cholines, phosphatidyl inositols, phosphatidic acids, and phosphatidyl ethanolamines.

Once the lipid material/oil has been purified according to the method of present invention, it may be further processed by e.g. catalytic process. Such processes may be e.g. catalytic cracking, thermo-catalytic cracking, catalytic hydrotreatment, fluid catalytic cracking, catalytic ketonization, catalytic esterification, or catalytic dehydration. Such processes require the oil to be sufficiently pure and freed from impurities that may otherwise hamper the catalytic process or poison the catalyst present in the process.

Thus, the invention comprises a method for purifying a lipid feed or oil, wherein the method comprises the steps of:

a) providing a feed of lipid material, b) heat treating the lipid material without adding water or other solvent, c) post treating the lipid material to thereby remove phosphorous and/or metal compounds from the lipid material.

In another aspect, the invention relates to a method comprising the steps of a) providing a feed of lipid material, b) heat treating the lipid material without added water or other solvent characterised in that heat treatment takes place at any temperature in the range of about 240° C. to about 280° C., c) post treating the lipid material to thereby reduce the amount of phosphorous and/or metal compounds in the lipid material.

In yet a further aspect, the invention relates to a method comprising the steps of a) providing a feed of lipid material, b) heat treating the lipid material without added water or other solvent characterised in that the residence time in step b) is maintained during a period of about 1 minute to about 30 minutes, such as about 5 minutes to about 30 minutes, c) post treating the lipid material to thereby reduce the amount of phosphorous and/or metal compounds in the lipid material.

In yet another aspect, the invention relates to a method comprising the steps of a) providing a feed of lipid material, b) heat treating the lipid material without added water or other solvent characterised in that heat treatment takes place at any temperature in the range of about 240° C. to about 280° C., and further characterised in that the residence time in step b) is maintained during a period of about 1 minute to about 30 minutes, such as about 5 minutes to about 30 minutes, c) post treating the lipid material to thereby reduce the amount of phosphorous and/or metal compounds in the lipid material.

As mentioned previously herein, it is to be understood that the post treatment step may comprise one or more subsequent steps, such as e.g. water treatment of the heat treated lipid material which may be followed by one or more subsequent purification steps as considered needed.

The lipid material/oil to be purified may be of plant, microbial and/or animal origin. It may also be any waste stream received from processing of oil and/or fats. Non-limiting examples are one or more of tall oil or the residual bottom fraction from tall oil distillation processes, animal based oils or fats, vegetable or plant based oil or fat such as e.g. sludge palm oil or used cooking oil, microbial or algae oils, free fatty acids, or any lipids containing phosphorous and/or metals, oils originating from yeast or mould products, oils originating from biomass, rapeseed oil, canola oil, colza oil, tall oil, sunflower oil, soybean oil, hemp oil, olive oil, linseed oil, cottonseed oil, mustard oil, palm oil, arachis oil, castor oil, coconut oil, animal fats such as suet, tallow, blubber, recycled alimentary fats, starting materials produced by genetic engineering, and biological starting materials produced by microbes such as algae and bacteria or any mixtures of said feedstocks.

In particular, the lipid material may be animal fats and/or used cooking oil. It is to be understood that used cooking oil may comprise one or more of the above mentioned oils such as e.g. rapeseed oil, canola oil, colza oil, tall oil, sunflower oil, soybean oil, hemp oil, olive oil, linseed oil, cottonseed oil, mustard oil, palm oil, arachis oil, castor oil, coconut oil.

The lipid material used in the process may also be fossil based oils, such as e.g. various oils used and produced by the oil industry. Non-limiting examples are various petroleum products such as e.g. fuel oils and gasoline (petrol). The term also encompasses all used products in either the refining process or e.g. spent lubrication oils.

In the process according to the invention, the heat treatment in step b) is performed without addition of any water or other solvents. The only water present in the heating step is the water already present in the lipid feed/oil. The water content of the lipid feed/oil to be purified in the method according to the invention is lower or equal to about 10000 ppm, such as e.g. lower than about 5000 ppm, such as e.g. lower than about 2000 ppm, such as e.g. lower than about 1500 ppm, such as e.g. lower than about 1000 ppm, such as e.g. lower than about 500 ppm, such as e.g. lower than about 250 ppm, such as e.g. lower than about 100 ppm, such as e.g. lower than about 50 ppm, such as e.g. lower than about 25 ppm, such as e.g. lower than about 10 ppm, such as e.g. lower than about 5 ppm, such as e.g. lower than about 1 ppm or such that the lipid feed/oil is substantially water free.

The heat treatment step according to step b), takes place at any temperature in the range of e.g. about 200° C. to about 300° C. It is to be understood that wherever it is stated in the description that e.g. heating takes place during a certain amount of time, this means that the specified period of time commences once the specified temperature is achieved.

Thus the temperature according to step b) may be e.g. about 210° C. to about 290° C., such as e.g. 220° C. to about 280° C., such as e.g. 230° C. to about 270° C., such as e.g. 240° C. to about 260° C., such as e.g. about 230° C. to about 280° C., such as e.g. about 240° C. to about 280° C. or about 200° C., about 210° C., about 220° C., about 230° C., about 240° C., about 250° C., about 260° C., about 270° C., about 280° C., about 290° C., about 300° C.

Specifically, the temperature in step b) may be in range of about 220° C. to about 280° C., or 220° C. to about 260° C., or about 260° C. to about 280° C., or about 230° C. to about 280° C., or about 240° C. to about 280° C. Moreover, the temperature may be about 220° C., or about 230° C., about 240° C., about 260° C., about 280° C.

The time during which the mixture is heated and held at the desired temperature, residence time, in step b) is about 1 minute to about 420 minutes, such as e.g. about 10 minutes to about 180 minutes, such as e.g. about 5 minutes to about 60 minutes, such as e.g. about 10 minutes to about 60 minutes, such as about 20 minutes, about 30 minutes, about 40 minutes, about 50 minutes or about 60 minutes, or about 5 minutes, about 10 minutes, about 20 minutes, about 30 minutes, about 40 minutes, about 50 minutes, about 60 minutes, about 90 minutes or about 180 minutes.

Ideally the time during which the desired temperature in step b) is held is about 5 minutes to about 30 minutes.

The method according to the invention may optionally comprise a water treatment step as part of the post treatment step (step c). The amount of water added in the water treatment step may be e.g. about 0.05 wt % to about 10 wt %, such as e.g. about 0.1 wt % to about 5 wt %, such as e.g. about 0.2 wt %, about 0.5 wt %, about 13 wt % or about 4 wt % to weight of the heat treated lipid feed/oil.

Preferably the amount of water is in range of e.g. about 1 wt % to about 5 wt % to weight of the heat treated lipid feed/oil.

The water may be removed by any suitable technique known to a person skilled in the art such as e.g. evaporation. After the evaporation of water the remaining solid impurities may be removed by any suitable technique known to a person skilled in the art such as e.g. filtration.

The temperature in water treatment in step c), is in range of may be e.g. about 50° C. to about 250° C., such as e.g. 60° C. to about 240° C., such as e.g. 70° C. to about 230° C., such as e.g. 80° C. to about 220° C., or about 80° C., about 130° C., about 220° C.

Specifically, the temperature in water treatment in step c) may be about 80° C., or about 130° C., about 220° C. The high temperatures may also enable the evaporation of water.

Residence time during the water treatment, i.e. the time of the elevated temperature, in step c) is maintained for a relatively short period of time in order to avoid hydrolysis of the purified lipid feed/oil. Consequently, the residence time is in range of about 0.1 minute to about 100 minutes about 1 minute to about 10 minutes, such as e.g. 1 minute to about 5 minutes.

Post treatment in step c may comprise an acid treatment step, where phosphoric acid or citric acid solution is added to heat treated lipid material. Treatment conditions may be similar as in the water treatment. For example, the acid may be present in an amount of e.g. about 100 ppm to about 10000 ppm and the temperature may be in range of about 80° C. to about 100° C. However, the condition during acid treatment may also be the same as for water treatment as seen above, with respect to amounts, temperature and residence times.

The method according to the invention comprises a post-treatment step (step c). The post treatment step may comprise various washing/degumming techniques or filtration or separation steps which may in turn be combined in any order with one another. As mentioned above, the post treatment step may comprise a water or acid treatment step. With respect to filtration, any filtration technique known in the art can be used. Separation may include any suitable separation technique such as e.g. centrifugation or phase separation. It is to be clearly understood that e.g. filtration and centrifugation may be combined. With respect to centrifugation, such operation may be performed during anytime that is deemed suitable, such as e.g. during a period of about 1 minutes to about 30 minutes, such as e.g. about 5 minutes to about 30 minutes or about 10 minutes etc.

Moreover, the temperature at which filtration or centrifugation takes place may be in any suitable range, such as e.g. about 50° C. to about 250° C., such as e.g. 60° C. to about 240° C., such as e.g. 70° C. to about 230° C., such as e.g. 80° C. to about 220° C., or about 60° C., about 80° C., about 130° C., or about 220° C.

Specifically, the temperature during filtration or centrifugation may be about 60° C., or about 100° C.

Further suitable post-treatment techniques that may be employed according to the invention are e.g. acid or water degumming or bleaching.

With respect to water washing or degumming, this operation may be undertaken at a temperature of e.g. about 50° C. to about 250° C., such as e.g. 60° C. to about 240° C., such as e.g. 70° C. to about 230° C., such as e.g. 80° C. to about 220° C., or about 80° C., about 130° C., about 220° C. Preferably the temperature is in range of about 60° C. to about 80° C. Degumming is usually undertaken in temperatures which are lower than about 100° C.

The post treatment step may be performed in any suitable way according to the process in question. It is thus to be understood that any suitable technique or techniques may be employed in any order.

FIGURES

Figure 1:
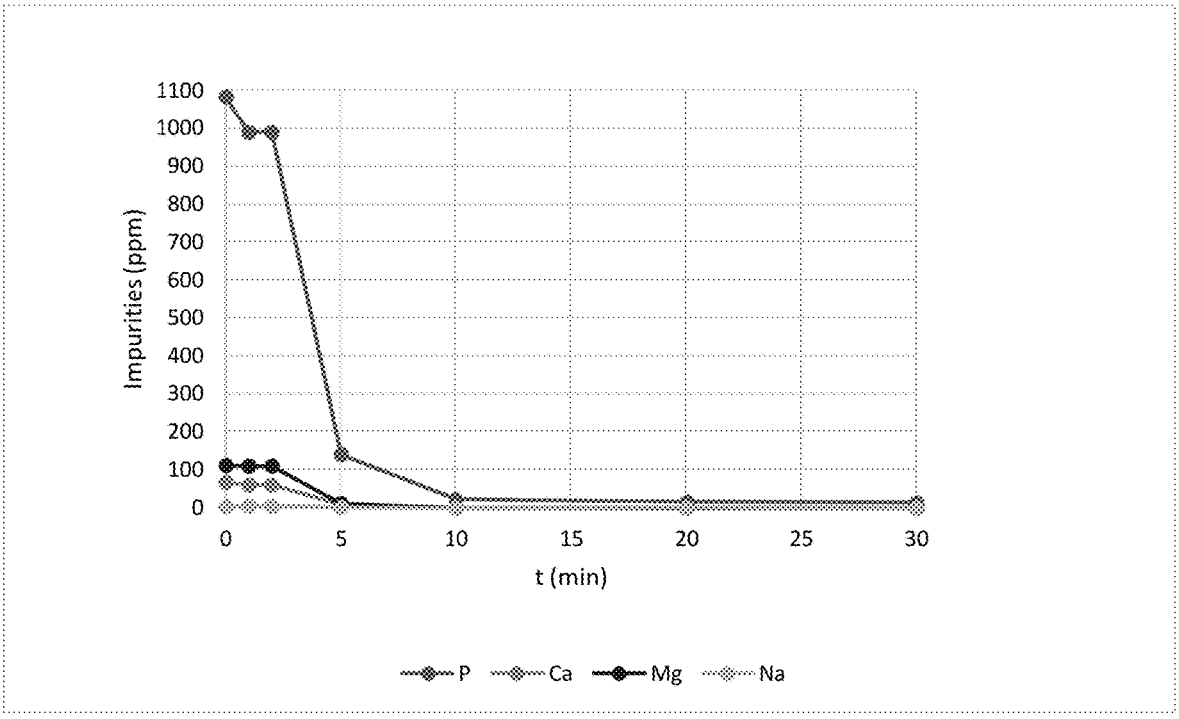
FIG. 1 illustrates the impurities in samples centrifuged in heat treatment of lecithin at 240° C. and how the amounts of the impurities vary over time.

In specific embodiments the invention also relates to the following items:

1. A method for purification of lipid material, the method comprising a) Providing a feed of lipid material, b) optionally pre-treating the lipid material, c) heat treating the lipid material, d) optionally subjecting the heat treated lipid material to a water treatment step, e) post treating the lipid material to thereby purify the lipid material from phospholipids 2. The method according to item 2, wherein the lipid material is a plant based or animal based fat or oil or wax or any combination thereof.

3. The method according to according any of the preceding items, wherein the pre-treatment may comprise water degumming, acid degumming, filtration and bleaching or any combinations thereof and in any order.

4. The method according to any of the preceding items, wherein the method does not comprise steps b) and/or d)

5. The method according to any of the preceding items, wherein the heating in step c) is performed at a temperature of e.g. about 200° C. to about 300° C.

6. The method according to any of the preceding items, wherein the heating in step c) is performed in the absence of any added water.

7. The method according to any of the preceding items, wherein the heating in step c) is maintained during a period of about 1 minute to about 30 minutes, such as about 5 minutes to about 30 minutes.

8. The method according to any of the preceding items, wherein water washing step d) is performed in the presence of water in an amount of e.g. about 1 wt % to about 5 wt % to the volume of the lipid material.

9. The method according to any of the preceding items, wherein water washing step d) is performed at a temperature of about e.g. 130° C. to about 220° C.

10. The method according to any of the preceding items, wherein water washing step d) is performed during a period of about 1 minute to about 30 minutes, such as about 5 minutes to about 30 minutes.

11. The method according to any of the preceding items, wherein water in the washing step d) is removed by flash evaporation.

12. The method according to any of the preceding items, wherein any solids in the water washing step d) are removed by one or more of filtration, degumming or bleaching or any combinations thereof.

13. The method according to any of the preceding items, wherein post-treatment step e) comprises water washing/degumming or acid degumming.

14. The method according to any of the preceding items, wherein step e) comprises an amount of water of about 1 wt % to about 5 wt % to the volume of the lipid material.

15. The method according to any of the preceding items, wherein the water washing/degumming in step e) is performed at a temperature of about 60° C. to about 80° C.

16. The method according to any of the preceding items, wherein post-treatment step e) comprises a centrifugation step to remove impurities formed during the process.

17. The method according to any of the preceding items, wherein post-treatment step e) further comprises a bleaching treatment to remove trace impurities.

18. The method according to any of the preceding items, wherein the phospholipids are one or more of phosphatidyl ethanolamines, phosphadityl cholines, phosphatidyl inositols, phosphatidic acids, and phosphatidyl ethanolamines.

In another aspect, the invention further relates to the following articles:

1. A method for purification of lipid material, the method comprising a) Providing a feed of lipid material, b) heat treating the lipid material without added water or other solvent, c) post treating the lipid material to thereby reduce the amount of phosphorous and/or metal compounds in the lipid material.

2. The method according to article 1, wherein the lipid material is a plant based, microbial based or animal based lipid or any combination thereof.

3. The method according to article 1, wherein the lipid material is of fossil based origin, such as e.g. various products and by-products produced by the oil industry, such as e.g. various petroleum products such as e.g. fuel oils and gasoline (petrol) or spent lubrication oils.

4. The method according to any of the preceding articles, wherein the water content of the lipid material in the feed is lower than about 10000 ppm, such as e.g. lower than about 5000 ppm, such as e.g. lower than about 2000 ppm, such as e.g. lower than about 1500 ppm, such as e.g. lower than about 1000 ppm, such as e.g. lower than about 500 ppm, such as e.g. lower than about 250 ppm, such as e.g. lower than about 100 ppm, such as e.g. lower than about 50 ppm, such as e.g. lower than about 25 ppm, such as e.g. lower than about 10 ppm, such as e.g. lower than about 5 ppm, such as e.g. lower than about 1 ppm or such that the lipid feed/oil is substantially water free.

5. The method according to any of the preceding articles, wherein the method does not comprise step c).

6. The method according to any of the preceding articles, wherein the temperature in step b) is performed at any temperature in the range of e.g. about 200° C. to about 300° C.

7. The method according to any of the preceding articles, wherein residence time in step b) is maintained during a period of about 1 minute to about 30 minutes, such as about 5 minutes to about 30 minutes.

8. The method according to any of the preceding articles, wherein step c) comprises a water treatment step which is performed in the presence of water in an amount of e.g. about 1 wt % to about 5 wt % to the volume of the lipid material.

9. The method according to any of the preceding articles, wherein water treatment step c) is performed at a temperature of about e.g. 130° C. to about 220° C.

10. The method according to any of the preceding articles, wherein water treatment step c) is performed during a period of about 1 minute to about 30 minutes, such as about 5 minutes to about 30 minutes.

11. The method according to any of the preceding articles, wherein water in the lipid material is removed by evaporation.

12. The method according to any of the preceding articles, wherein any impurities in the water treatment step c) are removed by one or more of filtration, centrifugation or bleaching or any combinations thereof.

13. The method according to any of the preceding articles, wherein post-treatment step c) comprises water washing/degumming or acid treatment/degumming or bleaching.

14. The method according to any of the preceding articles, wherein step c) comprises an amount of water of about 1 wt % to about 5 wt % to the volume of the lipid material.

15. The method according to any of the preceding articles, wherein post-treatment step c) comprises a centrifugation and/or filtration step to remove impurities formed during the process.

16. The method according to any of the preceding articles, wherein post-treatment step c) further comprises a bleaching treatment to remove impurities.

17. The method according to any of the preceding articles, wherein phosphorous compounds are phospholipids, such as e.g. one or more of phosphatidyl ethanolamines, phosphadityl cholines, phosphatidyl inositols and phosphatidic acids.

18. A lipid material, obtainable by the method according to any of articles 1-17.

19. Use of a lipid material, obtainable by the method according to any of articles 1-17 in any catalytic process such as e.g. catalytic cracking, thermo-catalytic cracking, catalytic hydrotreatment, fluid catalytic cracking, catalytic ketonization, catalytic esterification, or catalytic dehydration.

20. Use of an unpurified lipid material in a method according to any of articles 1-17, for preparation of fuels or chemicals.

Definitions

The following abbreviations have been used in the examples.

| | |
|---|---|
| MAG | Monoacylglycerides |
| DAG | Diacylglycerides |
| TAG | Triacylglycerides |
| FFA | Free fatty acids |
| Olig | Lipid oligomers |
| AF | Animal fat |
| RSO | Rapeseed oil |
| UCO | Used cooking oil |
| CPO | Crude Palm oil |

EXAMPLES

The invention is now further illustrated in the following non-limiting examples. In the examples below the concentration of impurities is given in mg/kg in all examples. The lipid class composition (MAG, DAG, TAG, Olig, FFA) is in all examples given in area %.

Example 1. Heat Treatment of High Impurity Feed

Lecithin, a mixture of water degummed phospholipids of soybean oil and thus high in metals and phosphorus, was heat treated at T 240° C. and 210° C. A stirred pressure reactor with high boiling hydrocarbon solvent was heated to a temperature ca. 20° C. above the intended reaction temperature. Lecithin-solvent solution was fed to the heated reactor so that the final lecithin concentration in the reactor was 3.7 wt %. Samples were withdrawn from the reactor at certain retention time. Part of the samples were water treated with 5 wt % water at 80° C. (1 min vortex mixing). All samples were centrifuged for 10 min at 60° C. to remove formed solids.

Figure 2:
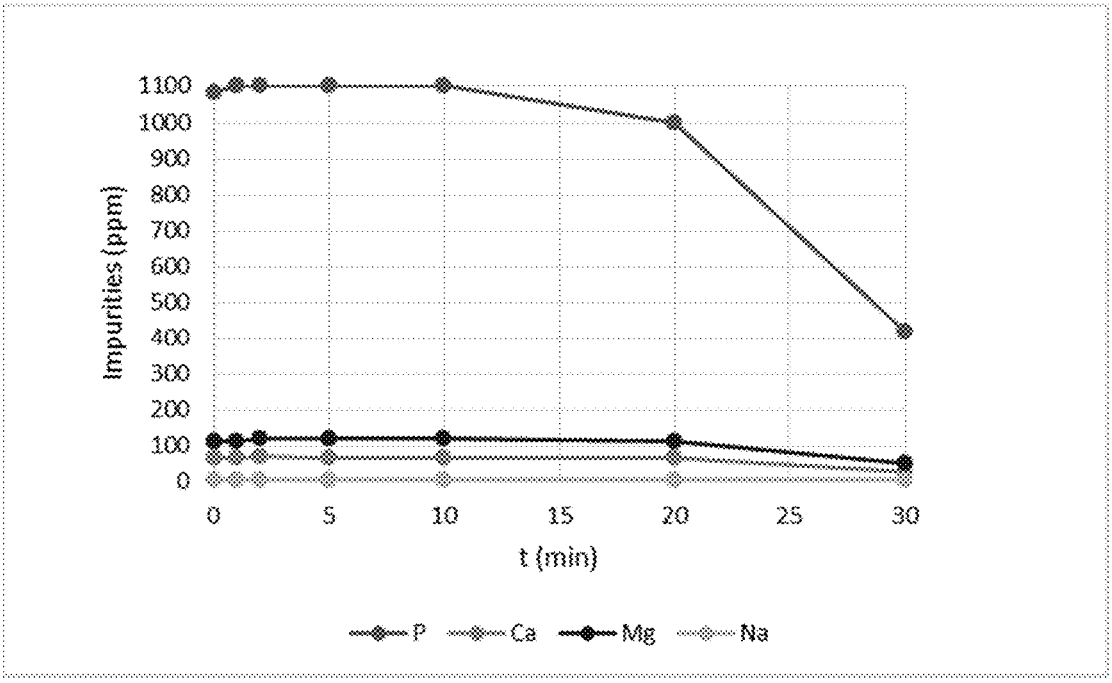
FIG. 2 illustrates the impurities in samples centrifuged in heat treatment of lecithin at 210° C. and how the amounts of the impurities vary over time.
Figure 3:
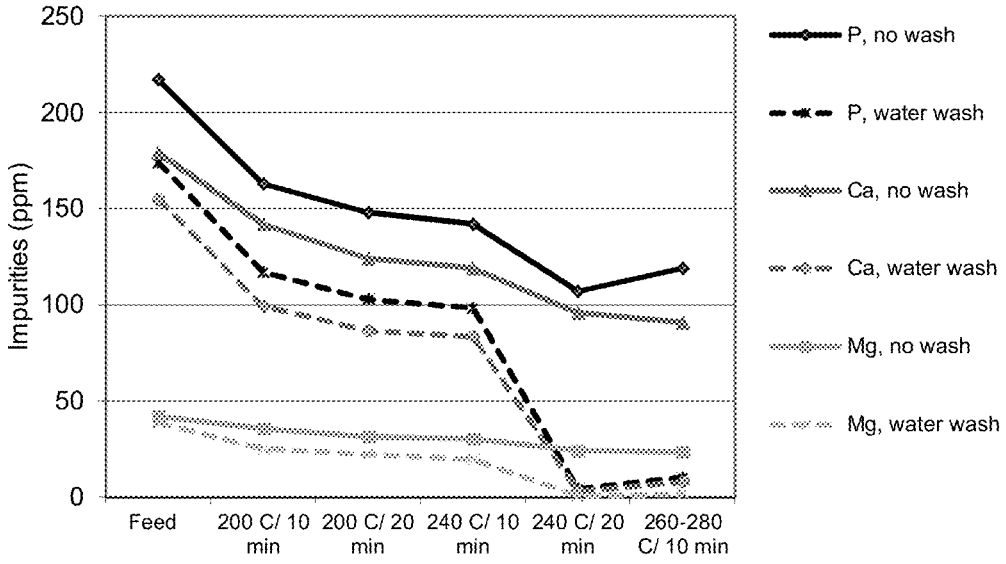
FIG. 3 illustrates impurities in RSO samples with no wash and with water wash.

Almost all impurities (metals and phosphorus) were removable by centrifugation after treatment at 240° C. for 5 min (FIG. 1, Table 1). At treatment temperature 210° C. the degradation of phospholipids is much slower and the level of impurities stayed high (FIG. 2, Table 2). Water treatment had small effect on the removal of impurities when treatment time had been long enough.

TABLE 1

Analysis results for centrifuged samples withdrawn from the reactor in heat treatment of lecithin at 240° C.

| t (min) | 0 (feed) | 1 | 2 | 5 | 10 | 20 | 30 |
|---|---|---|---|---|---|---|---|
| Fe | 0.9 | 1.7 | 1.7 | 0.3 | <0.1 | <0.1 | <0.1 |
| Na | 3.4 | 5.5 | 5.9 | 1.3 | <1 | 1.2 | <1 |
| Ca | 67 | 60 | 61 | 7.7 | 0.8 | 0.6 | 0.6 |
| Mg | 112 | 110 | 110 | 12 | 0.3 | <0.3 | <0.3 |
| P | 1082 | 990 | 990 | 140 | 23 | 16 | 14 |

TABLE 2

Analysis results for centrifuged samples withdrawn from the reactor in heat treatment of lecithin at 210° C.

| t (min) | 0 (feed) | 1 | 2 | 5 | 10 | 20 | 30 |
|---|---|---|---|---|---|---|---|
| Fe | 0.9065 | 1 | 1.1 | 1.1 | 1.1 | 1.1 | 0.5 |
| Na | 3.404 | 5.1 | 4.9 | 5.8 | 5.6 | 5.9 | 2.9 |
| Ca | 66.6 | 64 | 68 | 65 | 66 | 64 | 28 |
| Mg | 111.925 | 110 | 120 | 120 | 120 | 113 | 49 |
| P | 1082.25 | 1100 | 1100 | 1100 | 1100 | 1000 | 420 |
| After water treatment | | | | | | | |
| t (min) | feed | 1 | 2 | 5 | 10 | 20 | 30 |
| Fe | 0.9065 | 1.1 | 1.1 | 1.2 | 1 | 0.6 | 0.5 |
| Na | 3.404 | 4.7 | 4.7 | 5.4 | 4.2 | 3.4 | 2.7 |
| Ca | 66.6 | 70 | 71 | 72 | 59 | 37 | 27 |
| Mg | 111.925 | 120 | 120 | 120 | 98 | 61 | 45 |
| P | 1082.25 | 1100 | 1100 | 1100 | 840 | 530 | 380 |

Example 2. Heat Treatment of Rapeseed Oil in a Tube Reactor with and without Water Wash Water degummed rapeseed oil (RSO) was heat treated in a tube reactor for certain time and at certain temperature. Samples were centrifuged for 10 min at 60° C. after heat treatment. A sample was in addition water treated with 5 wt % water at 80° C. (1 min vortex mixing) and centrifuged for 10 min at 60° C.

From these results it can be seen that a heat treatment at 240° C. for 20 min or 260-280° C. for 10 min is enough to degrade phosphorous and metal containing compounds in rapeseed oil so that the impurities can be removed in a water treated. The samples that were only centrifuged had considerably more impurities than the water washed samples.

TABLE 3

Analysis results for RSO samples without and with water treatment.

| | feed | 200° C./ 10 min | 200° C./ 20 min | 240° C./ 10 min | 240° C./ 20 min | 260-280° C./10 min |
|---|---|---|---|---|---|---|
| No water treatment | | | | | | |
| Fe | 1 | 0.6 | 0.5 | 0.5 | 0.5 | 0.5 |
| Na | <1.0 | <1 | 2 | 2.3 | <1 | <1.0 |
| Ca | 179 | 142 | 124 | 119 | 95.8 | 90.8 |
| Mg | 42.1 | 35.7 | 31.5 | 30.5 | 24.2 | 23.5 |
| P | 217 | 163 | 148 | 142 | 107 | 119 |
| Water treatment | | | | | | |
| Fe | 0.5 | 0.4 | 0.3 | 0.3 | <0.1 | <0.1 |
| Na | <1.0 | 2.2 | 1.7 | 2.1 | 1.8 | 1.9 |
| Ca | 155 | 99.4 | 86.7 | 83.6 | 3.2 | 8.1 |
| Mg | 38.8 | 25.5 | 22.5 | 19.7 | 0.7 | 1.8 |
| P | 174 | 117 | 103 | 98.5 | 4.5 | 10.3 |

Example 3. Heat Treatment of Animal Fat in a Tube Reactor with and without Water Treatment Animal fat was heat treated in a tube reactor for certain time and at certain temperature. Samples were centrifuged for 10 min at 60° C. after heat treatment. A sample was in addition water treated with 5 wt % water at 80° C. (1 min vortex mixing) and centrifuged for 10 min at 60° C.

From these results it can be seen that a heat treatment at the tested temperature/time combinations were sufficient to make phosphorous and metals containing impurities in the oil removable in a simple water treatment. The samples that were only centrifuged had considerably more impurities than the water treated samples. Already water treatment of the untreated feed oil, results in considerable decrease in the level of impurities (P 124→46 ppm). Heat treatment followed by water wash decreased the P level to 6 ppm.

TABLE 4

Analysis results for AF samples without and with water treatment.

| | Feed | 236° C./ 25 min | 240 ° C./ 20 min | 253° C./ 20 min | 263 ° C./ 40 min |
|---|---|---|---|---|---|
| **No water treatment** | | | | | |
| Fe | 57.3 | 39 | 34.3 | 25.2 | 15.4 |
| Na | 22.5 | 19.8 | 18.3 | 15.2 | 10.1 |
| Ca | 97.4 | 73.3 | 68.3 | 52.7 | 34.9 |
| Mg | 24.5 | 18 | 16.9 | 12.6 | 7.5 |
| P | 124 | 94.7 | 87.6 | 64.9 | 41.4 |
| **Water treatment** | | | | | |
| | Feed | 236 ° C./ 25 min | 240 ° C./ 20 min | 253 ° C./ 20 min | 263 ° C./ 40 min |
| Fe | 28.5 | 2.9 | 2.6 | 2.7 | 1.5 |
| Na | 6.9 | 2.4 | 3.1 | 2.6 | 1.8 |
| Ca | 29.1 | 5.8 | 5.5 | 5.7 | 3.5 |
| Mg | 8.2 | 1.3 | 1.2 | 1.2 | 0.8 |
| P | 46.4 | 6.7 | 6.5 | 6.7 | 4.2 |

Example 4. Water Wash at Different Temperature for Heat Treated Animal Fat

Figure 4:
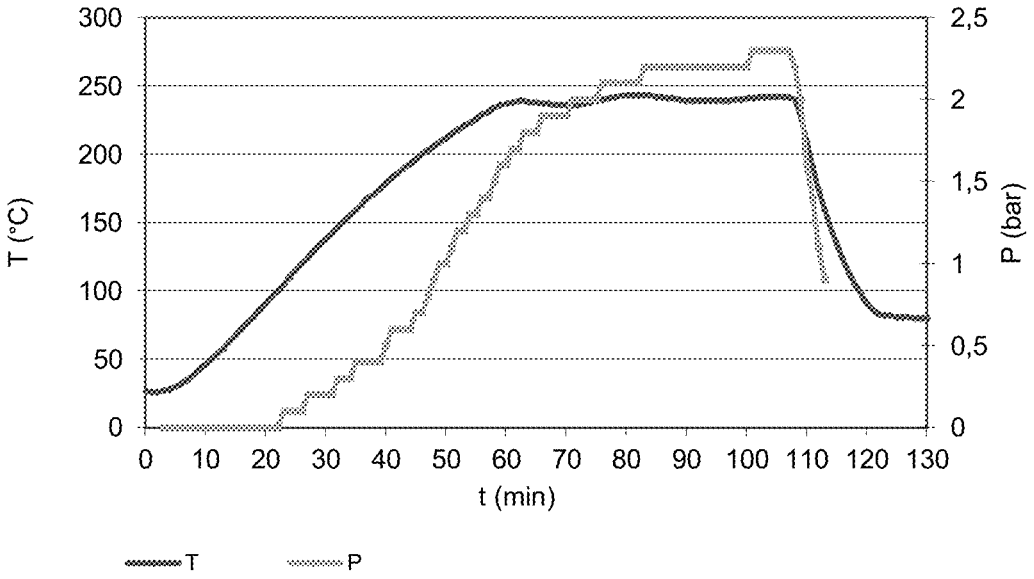
FIG. 4 illustrates the typical heating curve of batch heat treatment of animal fat at 240° C. for 30 min.
Figure 5:
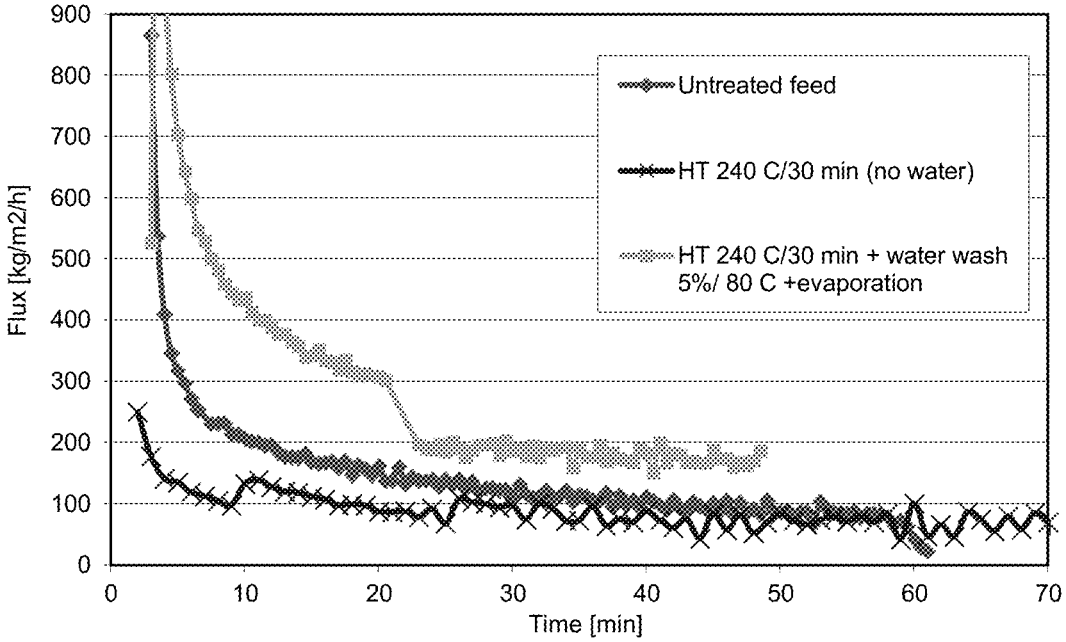
FIG. 5 illustrates the filtration fluxes for different feeds.

Animal fat was heat treated in a stirred pressure reactor at 500 rpm mixing. The oil was heated to 240° C. and kept there for a certain time, where after the reactor was cooled. A typical heating curve is presented in FIG. 4.

Heat treated animal fat (30 min at 240° C.) was water treated by adding 5 wt % water to the fat at specific temperature. Treatment temperatures were ca. 220° C., 150° C. and 80° C. At 220° C. and 150° C., water was fed to the fat in a pressure reactor from a feed vessel and mixed at 500 rpm. At 80° C., water was dispersed to the oil with a 2 min high sheer mixing, followed by mixing at 500 rpm. Samples were withdrawn at certain retention time and centrifuged (10 min/60° C.).

Figure 6:
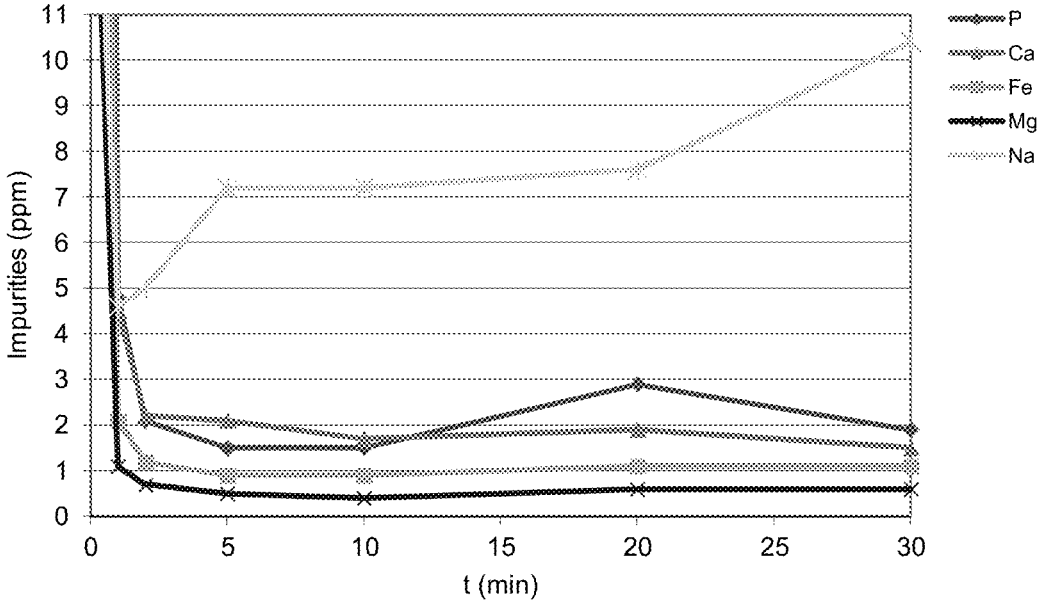
FIG. 6 illustrates the amount of impurities in oil after water wash with 5% water added at 240° C. (treatment temperature ca. 220° C.), samples withdrawn from the reactor at certain time and centrifuged and filtered.

At 220° C. the impurities were removed in centrifugation after only 2 min of contact time with water (Table, FIG. 6). At 5 min treatment time, the hydrolysis was minimal; at 30 min the product contained already 28 wt % FFA.

Figure 7:
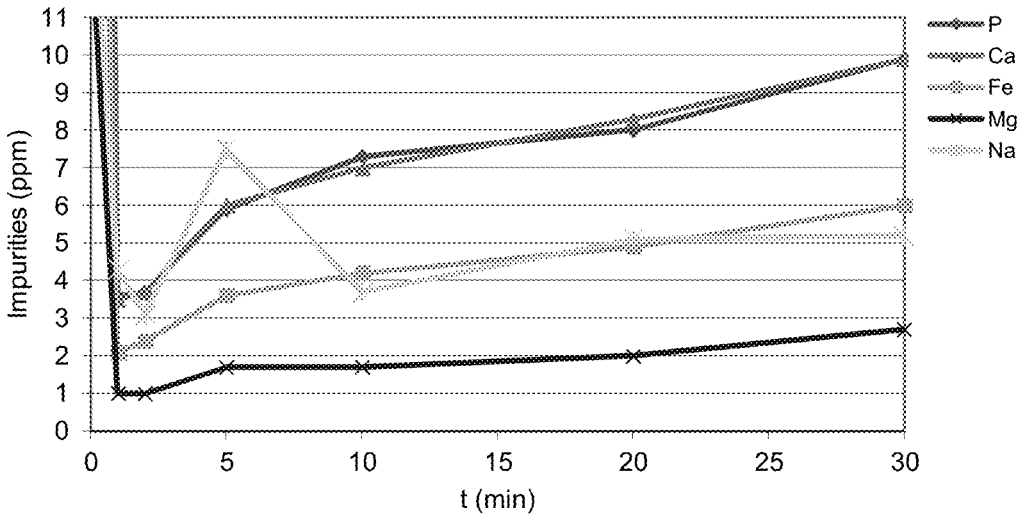
FIG. 7 illustrates the amount of impurities in oil after water wash with 5% water added at 160° C., samples withdrawn from the reactor at certain time and centrifuged.

At 150° C. the same trend is seen. A very short contact time is needed to remove impurities in centrifugation (Table 6, FIG. 7). Prolonged water treatment time can result in higher levels of impurities. Very little hydrolysis of the oil happens in 30 min.

Figure 8:
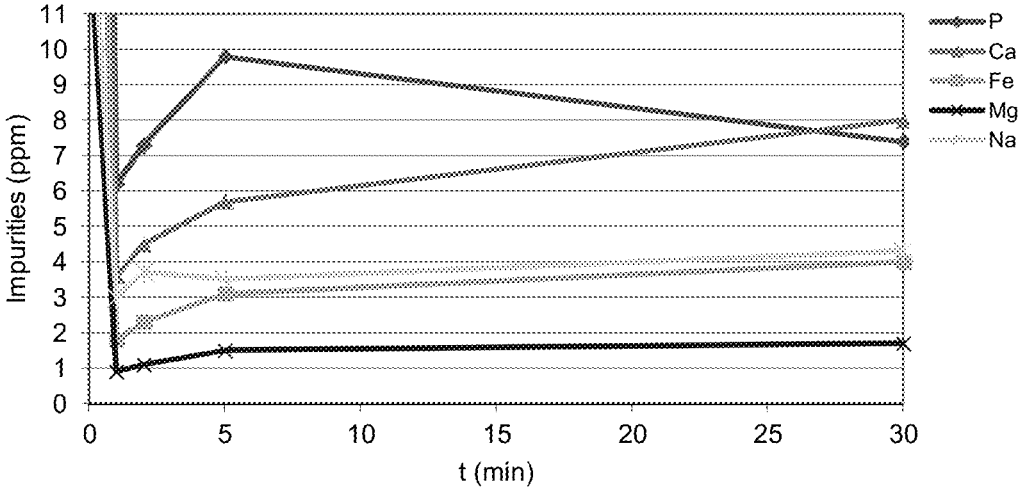
FIG. 8 illustrates the amount of impurities in oil after water wash with 5% water added at 80° C., samples withdrawn from the reactor at certain time and centrifuged.
Figure 9:
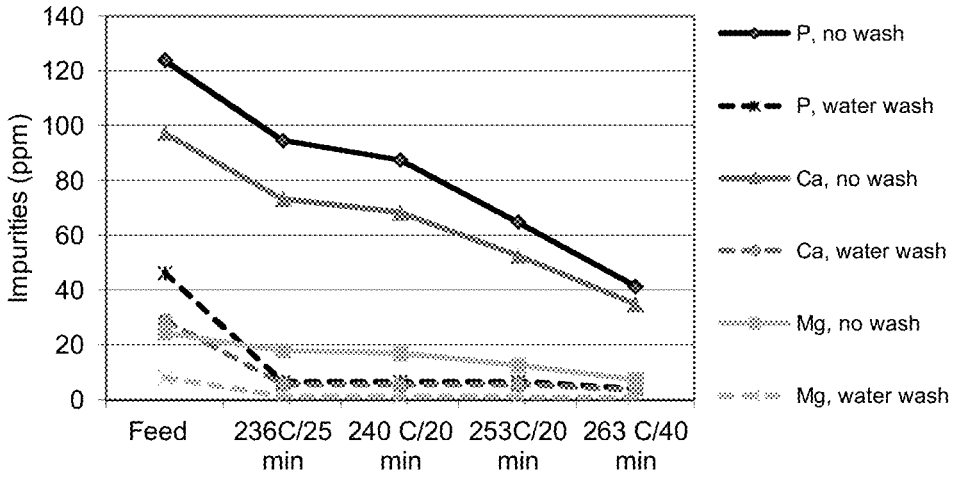
FIG. 9 illustrates the impurities in AF samples with no wash and with water wash and how the amounts of the impurities vary over time.

At 80° C. water treatment was also effective (Table, FIG. 8).

Water treatment at higher temperature (above 130° C.) enable evaporation of the water by flashing, where after solids can be removed by filtration or bleaching.

TABLE 5

5% water was added to animal fat at 240° C. after 30 min heat treatment, samples withdrawn from the reactor at certain time. Samples were centrifuged and filtered after treatment.

| water wt % | T (° C.) | t (min) | Fe | Na | Ca | Mg | P | MAG | DAG | TAG | Olig | FFA |
|---|---|---|---|---|---|---|---|---|---|---|---|---|
| 0 (before water addition | 240 | 30 | 41.4 | 18.2 | 77.4 | 17.7 | 99 | 1.5 | 22 | 58.8 | 0.8 | 17 |
| 5 | 220 | 1 | 2.1 | 4.6 | 4.5 | 1.1 | 4.8 | | | | | |
| 5 | 220 | 2 | 1.2 | 5 | 2.2 | 0.7 | 2.1 | | | | | |
| 5 | 220 | 5 | 0.9 | 7.2 | 2.1 | 0.5 | 1.5 | 1.9 | 23.2 | 56 | 0.9 | 18 |
| 5 | 220 | 10 | 0.9 | 7.2 | 1.7 | 0.4 | 1.5 | | | | | |
| 5 | 220 | 20 | 1.1 | 7.6 | 1.9 | 0.6 | 2.9 | | | | | |
| 5 | 220 | 30 | 1.1 | 10.4 | 1.5 | 0.6 | 1.9 | 5.4 | 28.5 | 37.4 | 0.8 | 28 |

TABLE 6

5% water added to animal fat at 160° C. after heat treatment (240° C./30 min), samples withdrawn from the reactor at certain time. Samples were centrifuged after treatment.

| water wt % | T (° C.) | t (min) | Fe | Na | Ca | Mg | P | MAG | DAG | TAG | Olig | FFA |
|---|---|---|---|---|---|---|---|---|---|---|---|---|
| 0 (before water addition) | 160 | 0 | 31.2 | 15.4 | 53.6 | 13.5 | 70 | 1.6 | 22.1 | 58.1 | 1.1 | 17 |
| 5 | 150 | 1 | 2.1 | 4.3 | 3.5 | 1 | 3.6 | | | | | |
| 5 | 150 | 2 | 2.4 | 3.1 | 3.7 | 1 | 3.7 | | | | | |
| 5 | 150 | 5 | 3.6 | 7.5 | 6 | 1.7 | 5.9 | | | | | |
| 5 | 150 | 10 | 4.2 | 3.7 | 7 | 1.7 | 7.3 | | | | | |
| 5 | 150 | 20 | 4.9 | 5.1 | 8.3 | 2 | 8 | | | | | |
| 5 | 150 | 30 | 6 | 5.2 | 9.9 | 2.7 | 9.9 | 2.1 | 23.9 | 55.2 | 1 | 18 |

TABLE 7

5% water added to animal fat at 80° C. after heat treatment (240° C./30 min), samples withdrawn from the reactor at certain time. Samples were centrifuged after the treatment.

| water wt % | T (° C.) | t (min) | Fe | Na | Ca | Mg | P | MAG | DAG | TAG | Olig | FFA |
|---|---|---|---|---|---|---|---|---|---|---|---|---|
| 0 (before water addition) | 80 | 0 | 31.2 | 15.4 | 53.6 | 13.5 | 70 | 1.6 | 22.1 | 58.1 | 1.1 | 17 |
| 5 | 80 | 2 | 1.8 | 3 | 3.6 | 0.9 | 6.2 | | | | | |
| 5 | 80 | 3 | 2.3 | 3.7 | 4.5 | 1.1 | 7.3 | | | | | |
| 5 | 80 | 5 | 3.1 | 3.5 | 5.7 | 1.5 | 9.8 | | | | | |
| 5 | 80 | 30 | 4 | 4.3 | 8 | 1.7 | 7.4 | 1.8 | 23.1 | 56.7 | 1.4 | 17 |

Example 5. Heat Treatment of Used Cooking Oil (UCO)

Heat treatment of used cooking oil was performed in a stirred pressure reactor as a batch experiment. The oil was heated to 240° C., kept there for 30 min and cooled. The heated UCO was treated such that a sample was centrifuged to remove solids, the rest of the oil was water treated (5% water, 2 min ultraturrax high shear mixing, 5 min 500 rpm mixing) and centrifuged. The water treated oil was additionally bleached (700 ppm citric acid, 0.2 wt % water, 0.5 wt % bleaching earth, mixing for 20 min at 80 C, drying and filtration).

Results for UCO are presented in Table. The result for bleaching of untreated UCO (700 ppm citric acid+0.2 wt-% water, 0.7 wt-% bleaching earth) is given as a reference.

Heat treatment of UCO followed by centrifugation did not result in any purification. However, heat treatment (240° C./30 min) followed by a water treatment with 5% water and bleaching treatment resulted in pure product.

Hence, the proposed process is suitable also for difficult feeds such as used cooking oil.

TABLE 8

Analysis results for used cooking oil.

| | | feed | feed water treated | Feed bleach. | HT + centrif. | HT + water treat-ment + centrif. | HT + water treat-ment + bleach. |
|---|---|---|---|---|---|---|---|
| MAG | area % | 5.1 | | | 3.9 | | 3.3 |
| DAG | area % | 15.2 | | | 21.8 | | 21.8 |
| TAG | area % | 63.2 | | | 56.7 | | 57.9 |
| Olig. | area % | 2.5 | | | 3.8 | | 3.3 |
| FFA | area % | 14 | | | 13.9 | | 13.7 |
| Fe | mg/kg | 3.1 | 1.5 | 0.4 | 5.6 | 1.7 | <0.1 |
| Cu | mg/kg | 1.6 | 0.2 | 0.4 | 0.3 | 0.3 | <1 |
| Si | mg/kg | 1.4 | 1.5 | 1.2 | 16.9 | 1 | <1 |
| Na | mg/kg | 14.3 | 3.6 | 2.7 | 2.2 | 1.8 | 0.7 |
| Ca | mg/kg | 57.6 | 31.7 | 2 | 69.6 | 20.2 | <0.3 |
| Mg | mg/kg | 2.7 | 0.9 | 0.3 | 3.4 | 1 | <0.3 |
| P | mg/kg | 42.7 | 20.5 | 5.8 | 44.2 | 13.5 | 0.9 |

Example 6. Heat Treatment of Crude Palm Oil (CPO)

Heat treatment of crude palm oil was performed in a stirred pressure reactor as batch experiment. The oil was heated to 240° C., kept there for 30 min and cooled.

After opening the reactor the oil and impurities were separated in two different ways. A sample was centrifuged at 60° C./10 min to remove the solids. Another sample was water treated with 5 wt % water at 80° C. (1 min vortex mixing) and centrifuged for 10 min at 60° C.

Results are given in Table 9. Results show that this process is also effective for "easy" feedstocks such as palm oil. Impurities are lowered considerably and only slight changes in lipid profile is seen.

TABLE 9

Analysis results for CPO samples.

| | Feed | HT + centrif. | HT + water treatment + centrif. |
|---|---|---|---|
| MAG | 1.1 | 1.8 | 1.8 |
| DAG | 13 | 18.9 | 19.7 |
| TAG | 78.3 | 67.5 | 66.9 |
| Olig. | <0.1 | 0.4 | 0.2 |
| FFA | 7.7 | 11.4 | 11.4 |
| Fe | 4.5 | 1.6 | 0.6 |
| Na | <1.0 | <1.0 | <1.0 |
| Ca | 13.5 | 4.5 | 1.9 |
| Mg | 1.6 | 0.8 | <0.3 |
| P | 13.7 | 4.6 | 1.6 |

Example 7 Heat Treatment Followed by Bleaching

Animal fat, which is very difficult to purity, was bleached (2000 ppm citric acid, 0.2 wt % water, 1 wt % bleaching earth, mixing for 20 min at 80 C, drying and filtration). Samples used were both untreated ones and ones after heat treatment at different conditions (temperature and time). Bleaching products after heat treatment were considerably purer than bleaching product of untreated feed. The more severe conditions (higher temperature and longer time) resulted in the better removal of metals and phosphorus.

The result for bleached products are presented in Table 10.

TABLE 2

Impurities in bleached feed and after heat treatment (HT).

| | Feed | Feed bleached | HT 280° C./ 5 min + bleach. | HT 230° C./ 5 min + bleach. | HT 280° C./ 30 min + bleach. | HT 230° C./ 30 min + bleach. |
|---|---|---|---|---|---|---|
| Fe | 0.39 | <0.1 | <0.1 | <0.1 | 0.12 | 0.14 |
| Na | 180 | 6.1 | 2 | 2.4 | <1.0 | <1.0 |
| Ca | 7.1 | 0.4 | <0.3 | <0.3 | <0.3 | 0.34 |
| Mg | 0.39 | 0.45 | <0.3 | <0.3 | <0.3 | <0.3 |
| P | 27 | 8.6 | 0.97 | 3.4 | <0.6 | 1.1 |

Example 8 Heat Treatment of Tall Oil Pitch (TOP) Followed by Acid Treatment

Untreated and heat treated (280° C./30 min in stirred pressure reactor) tall oil pitch samples (three different feeds) were acid treated at 90 C with phosphoric acid (PA) by mixing 1000-2000 ppm PA (added as 30-50% aqueous solution) to the feed with a high shear mixer for 1 min and continuing mixing with a magnetic stirrer for 60 min. At the end, temperature was raised to 100 C and the acid treated TOP was filtered through a precoat of cellulose fibre.

The purification (Table 11) and filterability of heat treated TOP after acid treatment was considerably better than that of untreated TOP.

TABLE 3

Acid treatment (AT) of untreated (comparative example) and heat treated (280° C./30 min) TOP after precoat filtration.

| | Fe | Na | Ca | Mg | P |
|---|---|---|---|---|---|
| TOP 1: feed | 39 | 470 | 26 | 3.4 | 120 |
| TOP 1: AT (1000 ppm PA (30%)) + F | 3.6 | 32 | 1.2 | <0.3 | 45 |
| TOP 1: HT + AT (1000 ppm PA (30%)) + F | <0.1 | 4.6 | 0.33 | <0.3 | 13 |
| TOP 2: feed | 230 | 730 | 15 | 5.1 | 93 |
| TOP 2: AT (2000 ppm PA (50%)) + F | 190 | 430 | 5.5 | 3.6 | 540 |
| TOP 2: HT + AT (2000 ppm PA (50%)) + F | 0.2 | 1.7 | 0.64 | <0.3 | 17 |
| TOP 3: feed | 33 | 630 | 8.9 | 3.4 | 68 |
| TOP 3: AT (2000 ppm PA (50%)) + F | 18 | 270 | 3.8 | 1.4 | 340 |
| TOP 3: HT + AT (2000 ppm PA (50%)) + F | 0.18 | 5.7 | 0.41 | <0.3 | 61 |

Comparative Example 1. Heat Treatment of Animal Fat with Different Amount of Water in Stirred Reactor Heat treatment of animal fat has been performed in a stirred pressure reactor as batch experiments with different amount of water (water added in the beginning and present during heating and cooling). The reactor with the oil and water was heated to 240° C. and kept there for 30 min before cooling the reactor.

After opening the reactor the oil and water was separated by centrifugation and the oil analysed for glyceride distribution.

Results are given in Table 12. Purest oil is gained with water contents 1-3 wt %. Hydrolysis of oil is low at up to 1 wt % water content, resulting in an increase of FFA from 18 wt % to 21 wt %. At higher water content undesirable hydrolysis of lipids is seen.

Hence, it is desirable to perform heat treatment with preferably lower than 1 wt % water and perform a water wash in a subsequent shorter step at lower temperature (Example 4).

TABLE 12

Glyceride distribution of heat treated animal fat with different amount of water. MAG, DAG, TAG, Olig. and FFA presented as area %.

| water (wt %) | T (° C.) | t (min) | MAG | DAG | TAG | Olig | FFA |
|---|---|---|---|---|---|---|---|
| | | | 1.6 | 18.1 | 62.2 | 0.3 | 18 |
| 0.5 | 240 | 30 | 2.1 | 25.5 | 53.1 | 0.4 | 19 |
| 1 | 240 | 30 | 3.2 | 28.1 | 46.9 | 1 | 21 |
| 3 | 240 | 30 | 5.8 | 31.6 | 32.2 | 0.6 | 30 |
| 10 | 240 | 30 | 15.1 | 21.2 | 5.5 | 0.1 | 58 |
| 20 | 240 | 30 | 11.4 | 13.7 | 2.9 | 0.5 | 72 |

The invention claimed is:

1. A method for purification of lipid material, the method comprising:

a) providing a feed of lipid material;

b) heat treating the lipid material without added water or other solvent wherein heat treatment takes place at any temperature in a range of 240° C. to 280° C., and wherein a residence time in step b) is maintained during a period of 1 minute to 30 minutes and wherein the lipid material has not undergone any pre-treatment prior to heating and wherein the heat treatment is performed in a pressure chamber; and c) post treating the lipid material by a water treatment step which is performed in a presence of water in an amount of 1 wt % to 3 wt % to a volume of the lipid material;

wherein water treatment step c) is performed at a temperature of 130° C. to 220° C., to thereby reduce an amount of phosphorous and/or metal compounds in the lipid material.

2. The method according to claim 1, wherein the lipid material is a plant based, microbial based or animal based lipid or any combination thereof.

3. The method according to claim 1, comprising:

selecting a water content of the lipid material in the feed to be lower than 10000 ppm, lower than 5000 ppm, lower than 2000 ppm, lower than 1500 ppm, lower than 1000 ppm, lower than 500 ppm, lower than 250 ppm, lower than 100 ppm, lower than 50 ppm, lower than 25 ppm, lower than 10 ppm, lower than 5 ppm, lower than 1 ppm or such that the lipid feed is substantially water free.

4. The method according to claim 1, comprising:

performing the water treatment step c) during a period of 1 minute to 30 minutes.

5. The method according to claim 1, comprising:

removing water in the lipid material by evaporation.

6. The method according to claim 1, comprising:

removing any impurities in the water treatment step c) by one or more of filtration, centrifugation or bleaching or any combinations thereof.

7. The method according to claim 1, wherein post-treatment step c) comprises:

water washing/degumming or acid treatment/degumming or bleaching.

8. The method according to claim 1, wherein post-treatment step c) comprises:

centrifugation and/or filtration to remove impurities formed during the process.

9. The method according to claim 1, wherein post-treatment step c) comprises:

a bleaching treatment to remove impurities.

10. The method according to claim 1, wherein phosphorous compounds are phospholipids, selected from one or more of phosphatidyl ethanolamines, phosphadityl cholines, phosphatidyl inositols or phosphatidic acids.

11. A method for purification of lipid material according to claim 1, wherein a residence time in step b) is maintained during a period of 5 minutes to 30 minutes.

12. The method according to 1, comprising:

performing the water treatment step c) during a period of 5 minutes to 30 minutes.

* * * * *